US009163453B2

(12) United States Patent
Cheng

(10) Patent No.: US 9,163,453 B2
(45) Date of Patent: Oct. 20, 2015

(54) BOTTOM BAR FIXING DEVICE OF VENETIAN BLINDS

(71) Applicant: TAIWAN PAIHO LIMITED, Chang Hwa Hsien (TW)

(72) Inventor: Allen Cheng, Chang Hwa Hsien (TW)

(73) Assignee: TAIWAN PAIHO LIMITED, Chang Hwa Hsien (TW)

( * ) Notice: Subject to any disclaimer, the term of this patent is extended or adjusted under 35 U.S.C. 154(b) by 0 days.

(21) Appl. No.: 14/242,342

(22) Filed: Apr. 1, 2014

(65) Prior Publication Data

US 2015/0007947 A1 Jan. 8, 2015

(30) Foreign Application Priority Data

Jul. 8, 2013 (TW) ..... 102124383 A

(51) Int. Cl.
*E06B 9/388* (2006.01)

(52) U.S. Cl.
CPC ..... *E06B 9/388* (2013.01)

(58) Field of Classification Search
USPC ..... 160/178.1 R, 173 R, 290.1, 273.1; 16/422
IPC ..... E06B 9/388,9/325
See application file for complete search history.

(56) References Cited

U.S. PATENT DOCUMENTS

| | | | | | |
|---|---|---|---|---|---|
| 2,236,453 | A * | 3/1941 | Savage | 160/384 |
| 2,537,828 | A * | 1/1951 | Hoffman | 160/384 |
| 2,860,699 | A * | 11/1958 | Braun | 160/173 R |
| 3,485,286 | A * | 12/1969 | Abate et al. | 160/178.1 R |
| 4,088,173 | A * | 5/1978 | Antich | 160/238 |
| 6,170,553 | B1 * | 1/2001 | Villarreal-Chavez | 160/370.22 |
| 6,792,997 | B2 * | 9/2004 | Damiano | 160/178.1 R |
| 7,793,701 | B2 * | 9/2010 | Liang et al. | 160/178.1 R |
| 8,215,368 | B2 * | 7/2012 | Ellis | 160/178.1 R |
| 2004/0123958 | A1 * | 7/2004 | Krug | 160/178.1 R |
| 2005/0103451 | A1 * | 5/2005 | Nien | 160/173 R |
| 2007/0084567 | A1 * | 4/2007 | Chen | 160/84.05 |

* cited by examiner

*Primary Examiner* — David Purol
(74) *Attorney, Agent, or Firm* — Bacon & Thomas, PLLC

(57) ABSTRACT

One aspect of the present invention provides a bottom bar fixing device of Venetian blinds comprising: at least on first fixing elements attached to a lower face of a bottom bar of the Venetian blinds each including an engaging portion having a plurality of hooks formed thereon and an operation portion extending outwardly and upwardly from the engaging portion; and at least one second fixing elements attached to a wall, each second fixing element having loops for engaging with the hooks of the first fixing element in order to hold the bottom bar to the wall when the Venetian blinds is in a fully extended state by engaging the first and the second fixing elements.

3 Claims, 9 Drawing Sheets

BOTTOM BAR FIXING DEVICE OF VENETIAN BLINDS

FIELD OF THE INVENTION

The present invention relates generally to a Venetian blinds, and more specifically to a bottom bar fixing device of Venetian blinds.

BACKGROUND OF THE INVENTION

With the improvements in life that economic development brings, home is no longer just a place sheltering people from the rain, snow, wind and the sun, but a place to provide a more comfortable, safe and esthetic living environment.

In the general building, windows are the essential facilities for providing natural lighting and air circulation to the house, however, windows also have the shortcomings of causing the temperature in the house to rise by allowing the sunshine shines into the house directly; and providing an access to peek into the house causing the privacy may be violated, etc. In order to prevent things mentioned above from happening, window curtains, Venetian blinds or the like are normally installed to the windows. Among them, Venetian blinds become one of the most popular family decoration articles because of the various types of multifarious materials and colors that it can provide to the house, as well as because of the ornamental and decorative result it can provide. Though the Venetian blinds have above-mentioned advantages, it is also a potential hazardous article for family having little children. For example, a material announced by American consumer's security council (CPSC) reveals: Venetian blinds are responsible for several children's suffocation or injury accidents in U.S.A. in 2010 because lacking cord/rope tensioning/fixing device to prevent the cord/rope from raping around the neck of a child. Therefore, security becomes a most important factor when people selecting the Venetian blinds.

At present, there are generally two kinds of safe precaution measures being taken to this product in the industry, one by increasing the weight of the bottom bar the Venetian blinds to make it too heavy to be raised by a little child so as to prevent the cords/ropes become lax, and in turn eliminate the possibility of any Another safety measure is as shown in FIG. 1*a*-1*c*. As illustrated, a holding pin 1 is installed in the wall where the window is located and a recess 3 is formed at both of a bottom bar 2 of the Venetian blinds. In use, the bottom bar 2 is fixed to the wall by inserting the pin 1 into the recess 3 so as to prevent the bottom bar from being accidently raised by children.

However, the above-mentioned safety measures have other shortcomings. For example, power tools, such as power drill, are usually required while installing the holding pin 1. This usually will cause some degree of damage to the wall or the floor as well as cause certain influence to the indoor esthetic decoration. In addition, this normally also increase manufacture and installation cost. Moreover, because the holding pin 1 protrudes from the wall or the floor after it is installed, the holding pin 1 itself becomes another safety issue that may endanger not only to little children but to every member of the family. As to the other safety measure of increasing the weight the bottom bar, because the bottom bar is still not being firmly fixed, it is still possible that the bottom bar may be raised by children and the possibility of the cord/rope raping around the neck of a child still exist. This can not be viewed as an effective safety measure.

Because the traditional sun blind safety measures have the above-mentioned shortcomings, it motivates the inventor of the present invention to improve the safety measure of existing Venetian blinds. After numerous attempts and experiments, the inventor of the present invention has finally achieve a bottom bar fixing device of a Venetian blinds that is able to overcome every shortcomings of the above-mentioned existing Venetian blinds effectively.

SUMMARY OF THE INVENTION

One object of the present invention is to provide a bottom bar fixing device of Venetian blinds that is able to prevent suffocation accidents causing by lax cords/ropes of the Venetian blinds from happening. Another object of the present invention is to provide a bottom bar fixing device of Venetian blinds that is easy to manufacture, manufacturing cost is low and easy to install.

The above objects may be achieved by a bottom bar fixing device of Venetian blinds which includes at least one first fixing elements attached to a lower face of a bottom bar of the Venetian blinds, each having an engaging portion having a plurality of hook members formed thereon and an operation portion extending outwardly and upwardly from the engaging portion; and at least one second fixing elements attached to a wall portion of a house, each second fixing element having loop portions formed thereon for engaging with the hook members of the first fixing element in order to releasably hold the bottom bar to the wall of the house when the Venetian blinds is in a fully extended state by engaging the first and the second fixing elements.

According to one embodiment of the present invention, the at least one first fixing element is configured in a form of a ladder rope fixing plug, wherein the engaging portion is formed as an expanded base portion of the ladder rope fixing plug.

According to a second embodiment of the present application, a bottom bar fixing device of Venetian blinds is provided and it comprises:

two first fixing elements each attached to an end portion of the bottom bar and having a plurality of hook members formed on at least one of a lower face and a rear face thereof; and two second fixing elements each attached to wall portions of a house corresponding to the lower face and the rear face of the first fixing element and having a plurality of loops members formed thereon for releasably engaging with the hook members of the first fixing element when the Venetian blinds is in a fully extended state so as to releasably hold the bottom bar to the wall of the house.

Features and objects of the present invention other than the above will become more clear by reading the descriptions of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings, wherein.

DETAILED DESCRIPTION OF THE INVENTION

Figure 1A:
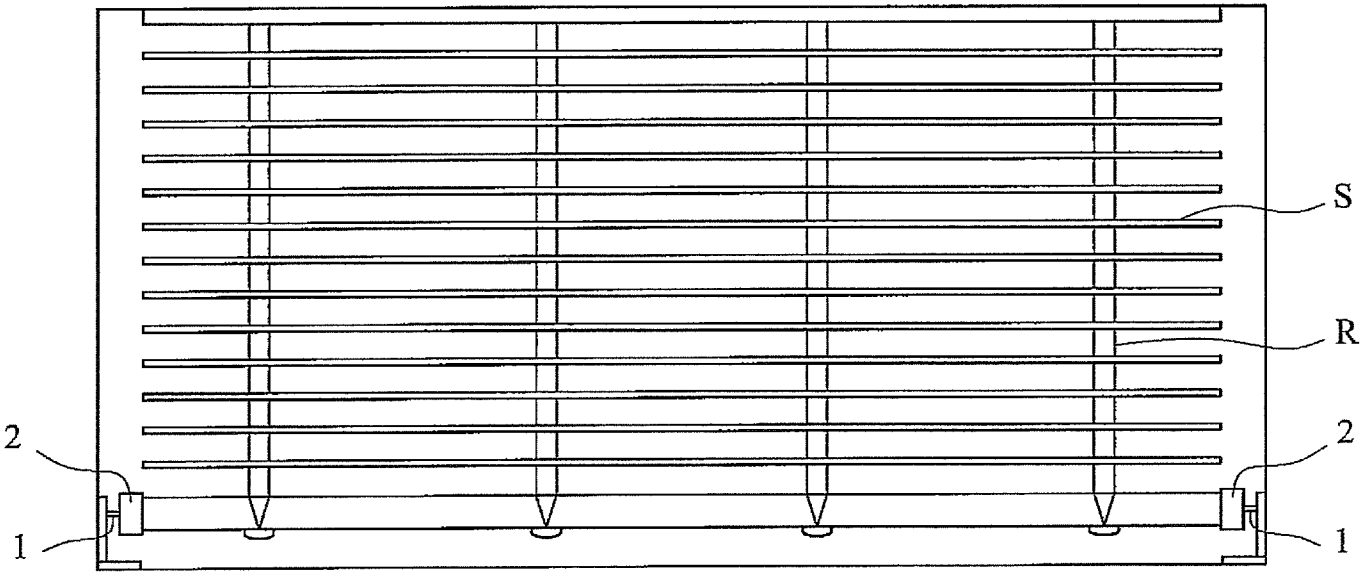
Fig.1a (Prior Art)
FIG. 1*a* is a schematic plane view illustrating Venetian blinds having a traditional bottom bar fixing device installed thereon.
Figure 1B:
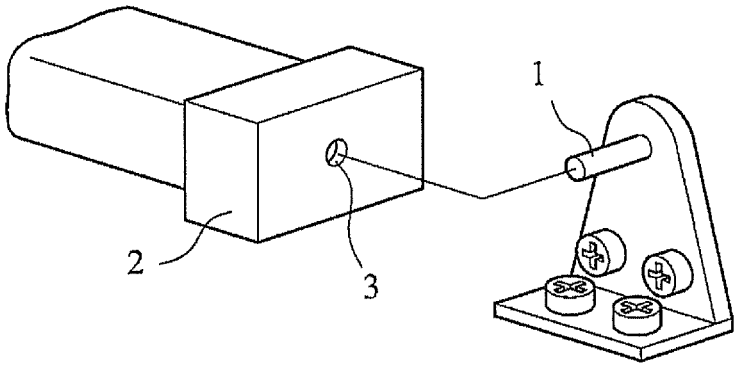
Fig.1b (Prior Art)
FIG. 1*b* is a schematic perspective view illustrating a traditional bottom bar fixing device of Venetian blinds.
Figure 1C:
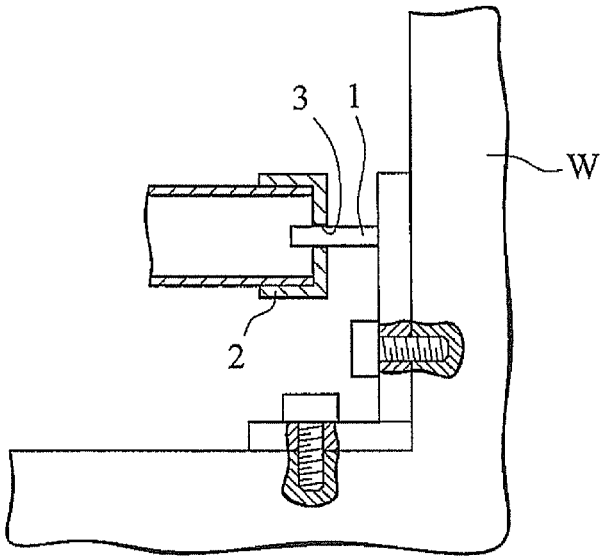
Fig.1c (Prior Art)
FIG. 1*c* is a partial cross-sectional view illustrating the traditional bottom bar fixing device of Venetian blinds of FIG. 1*b* being installed to a wall and the bottom bar.
Figure 2A:
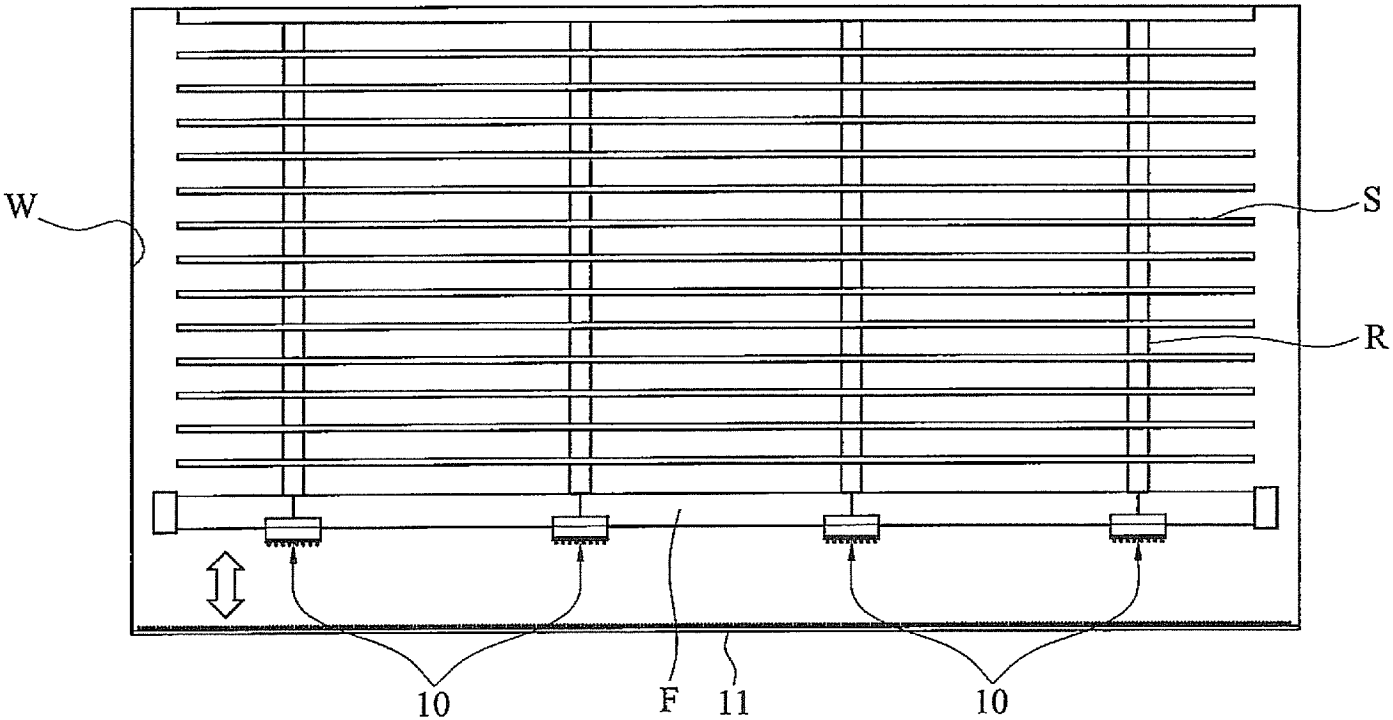
FIG. 2*a* is a schematic plane view illustrating Venetian blinds having a bottom bar fixing device according to a first embodiment of the present invention installed thereon.
Figure 2B:
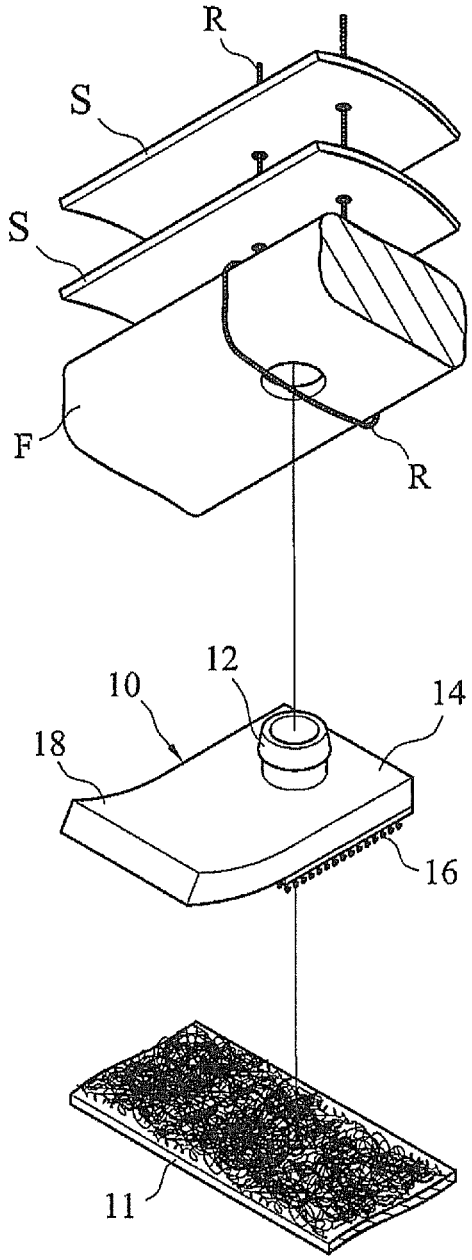
FIG. 2*b* is a schematic perspective view illustrating a bottom bar fixing device according to a first embodiment of the present invention.
Figure 2C:
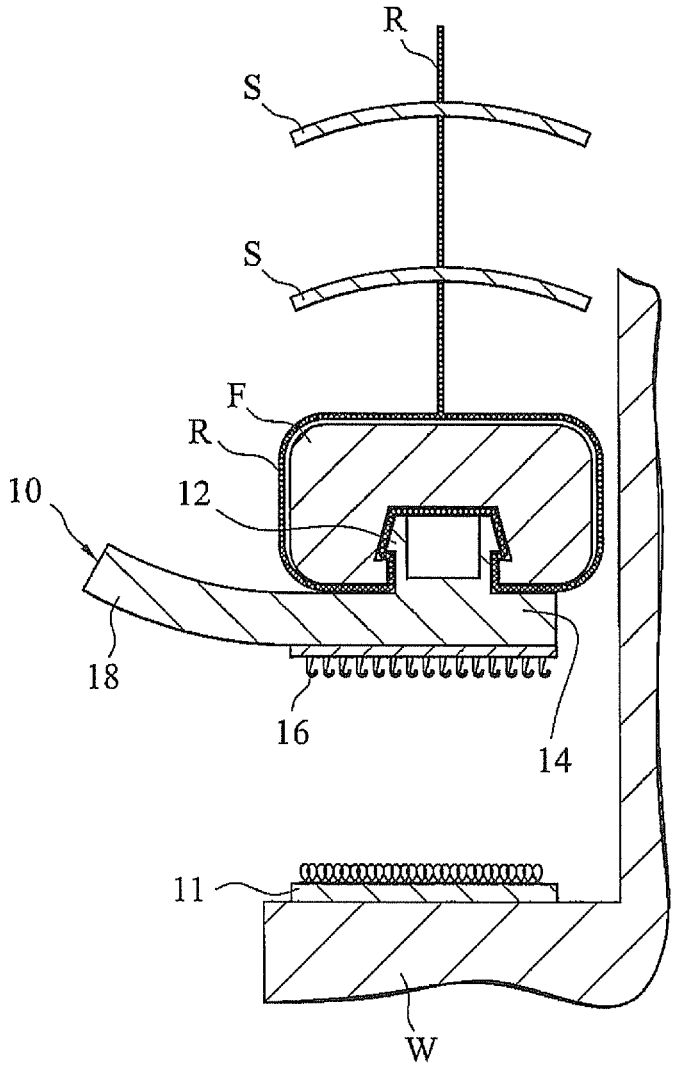
FIG. 2*c* is an enlarged cross-sectional view illustrating the bottom bar fixing device according to a first embodiment of the present invention wherein a first fixing element being attached to a bottom bar and a second fixing element being attached to a wall portion of a house.
Figure 2D:
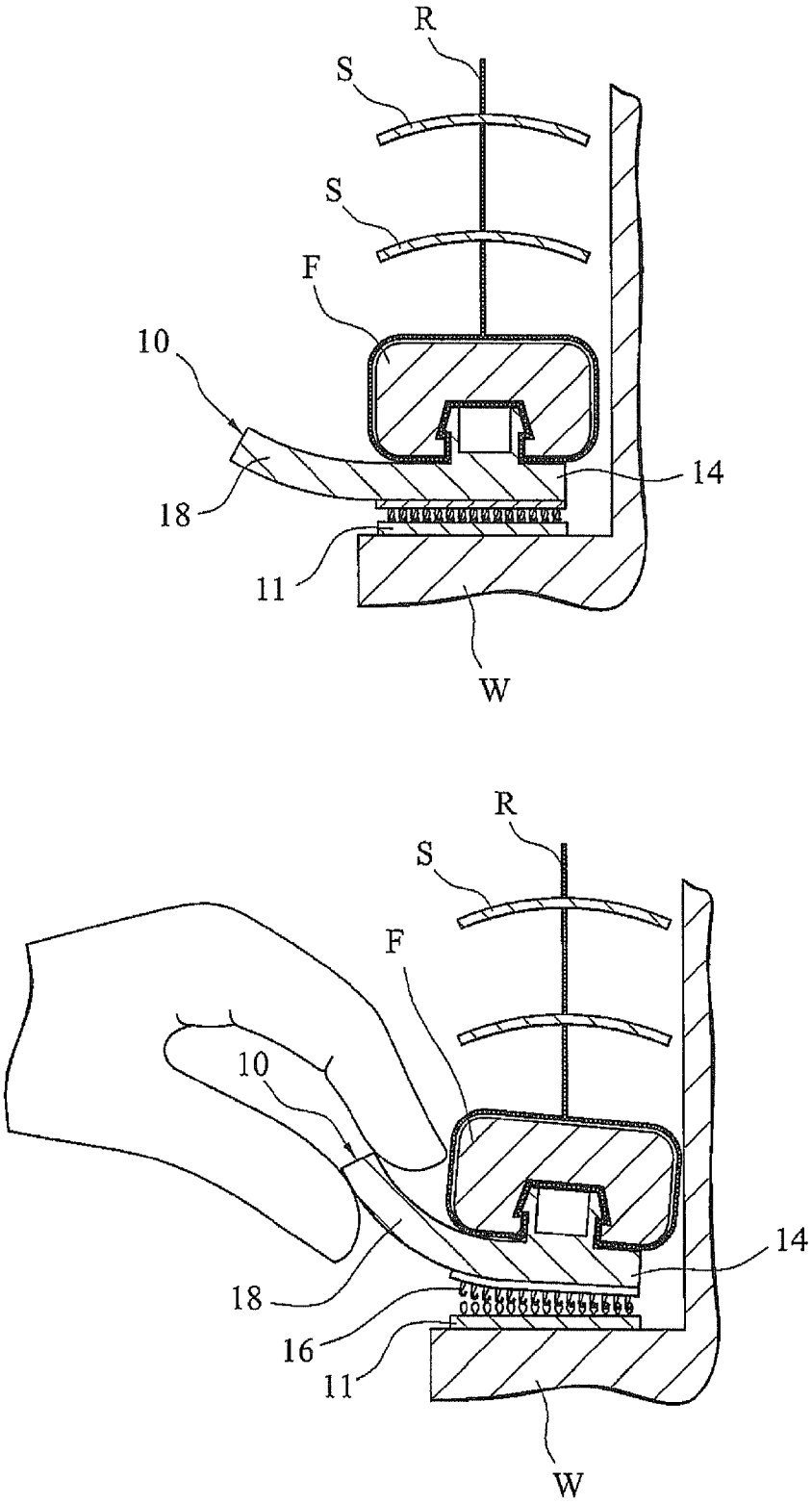
FIG. 2*d* is a cross-sectional end view illustrating the first and the second fixing elements of the bottom bar fixing device illustrated in FIG. 2*c* is a state of engaging with each other.
Figure 3A:
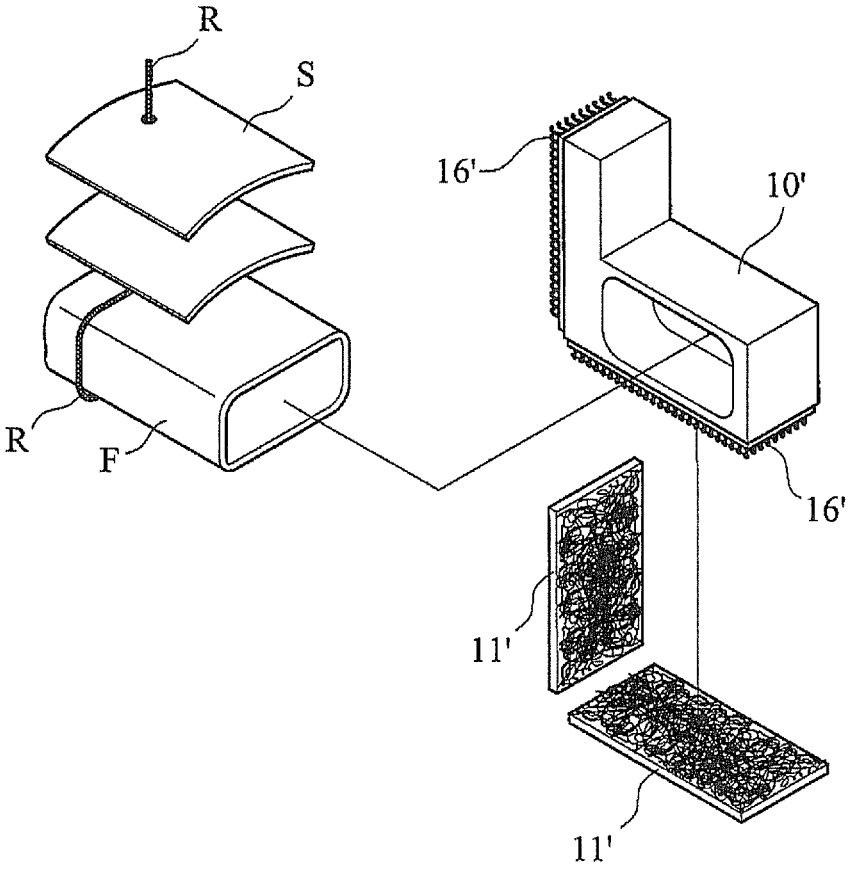
FIG. 3*a* is a schematic perspective view illustrating a bottom bar fixing device according to a second embodiment of the present invention.
Figure 3B:
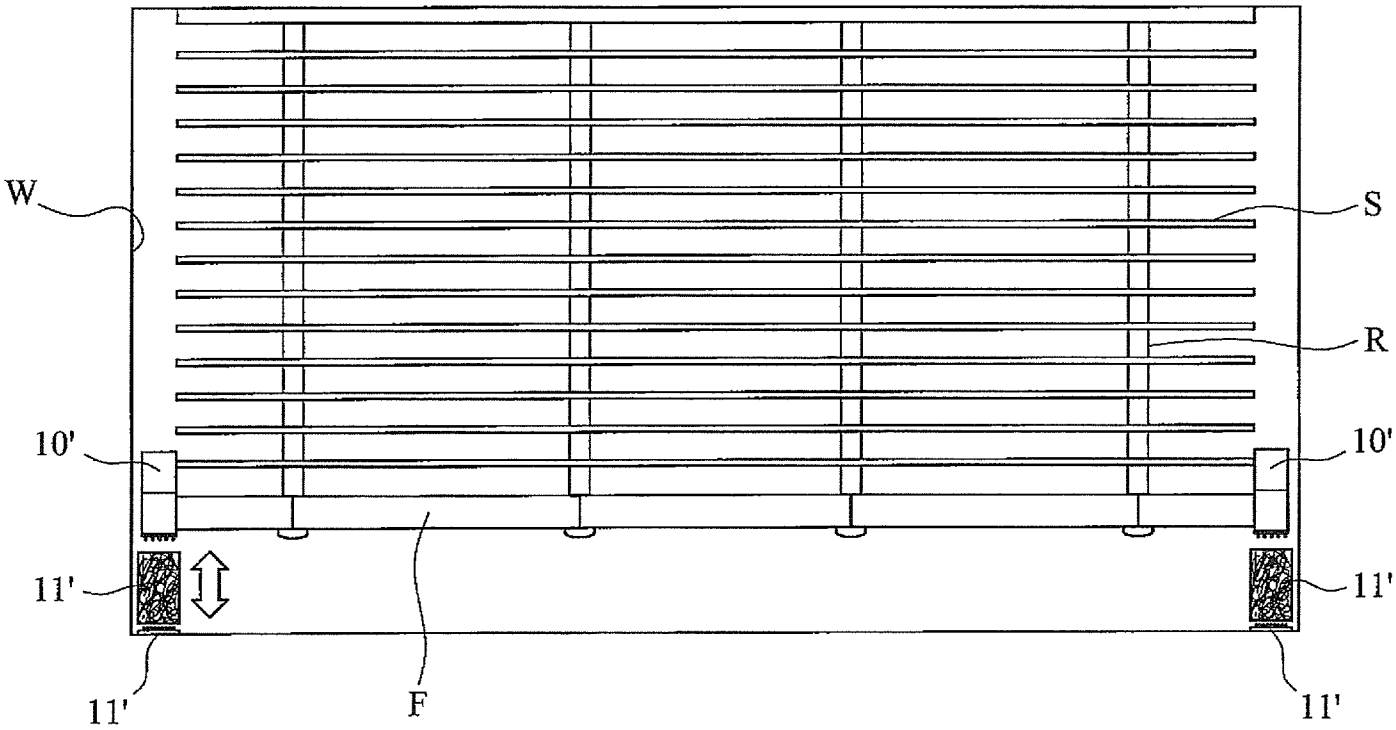
FIG. 3*b* is a schematic plane view illustrating Venetian blinds having a bottom bar fixing device according to the second embodiment of the present invention installed thereon.
Figure 3C:
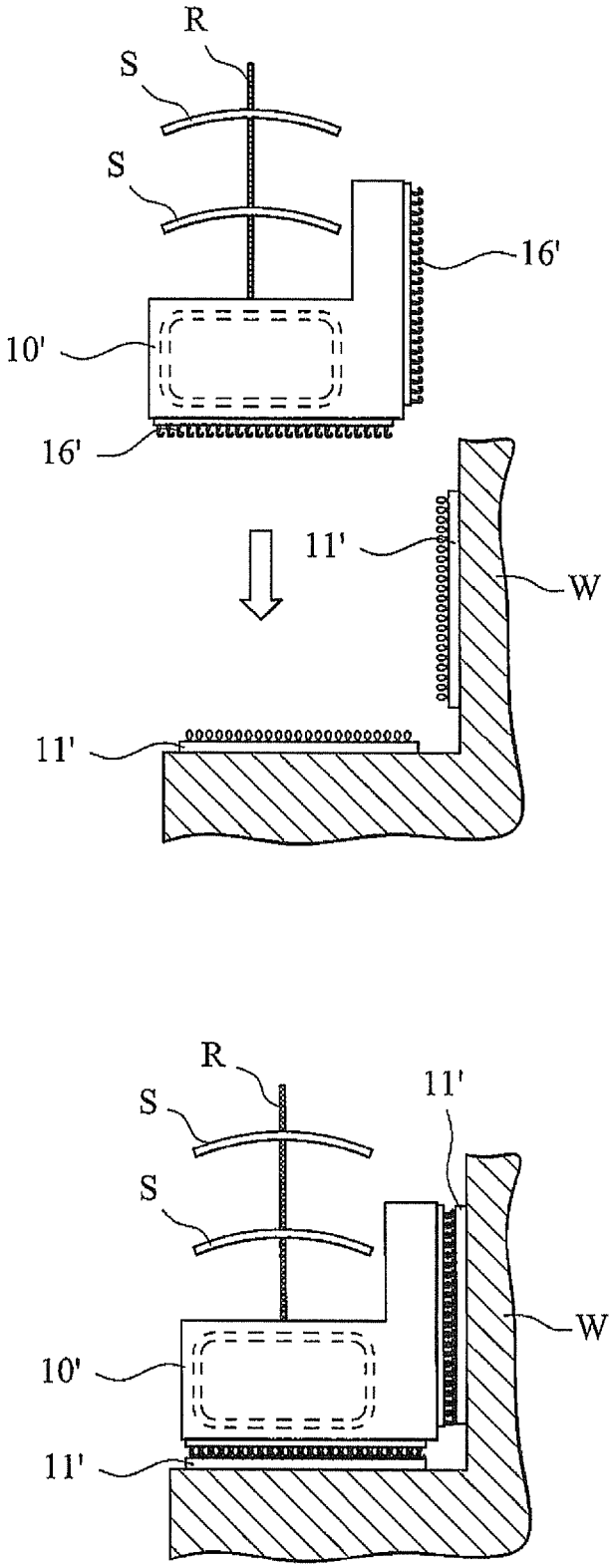
FIG. 3*c* is an enlarged schematic end view illustrating the operation of the bottom bar fixing device according to the second embodiment of the present invention.

Referring now to embodiments that are illustrated in drawings 2 and 3 to describe the bottom bar fixing device of Venetian blinds of the present invention, wherein FIG. 2*a* is a schematic plane view illustrating Venetian blinds having a bottom bar fixing device according to a first embodiment of the present invention installed thereon; FIG. 2*b* is a schematic perspective view illustrating a bottom bar fixing device according to a first embodiment of the present invention; FIG. 2*c* is an enlarged cross-sectional view illustrating the bottom bar fixing device according to a first embodiment of the present invention wherein a first fixing element being attached to a bottom bar and a second fixing element being attached to a wall portion of a house; FIG. 2*d* is a cross-sectional end view illustrating the first and the second fixing elements of the bottom bar fixing device illustrated in FIG. 2*c* is a state of engaging with each other; FIG. 3*a* is a schematic perspective view illustrating a bottom bar fixing device according to a second embodiment of the present invention; FIG. 3*b* is a schematic plane view illustrating Venetian blinds having a bottom bar fixing device according to the second embodiment of the present invention installed thereon; and FIG. 3*c* is an enlarged schematic end view illustrating the operation of the bottom bar fixing device according to the second embodiment of the present invention.

As illustrated in FIGS. 2*a*-2*d*, the bottom bar fixing device of Venetian blinds according to the first embodiment of the present invention includes a plurality of first fixing elements 10, for instant 4 first fixing elements 10 are illustrated in FIG. 2*a*. In this embodiment, the first fixing element 10 is configured in the form as a ladder rope fixing plug which includes an installation portion 12 for inserting into a hole in a bottom bar F of the Venetian blinds so as to attach the first fixing element 10 to the bottom bar F. Additionally, the first fixing element 10 further includes an engaging portion 14 which is formed as an expanded base of a ladder rope fixing plug and has a plurality of hook members 16 provided on a lower face thereof, which may be obtained by attaching a hook fastener strap which has a plurality of hooks formed thereon to a lower face of the engaging portion 14. The first fixing element 10 further includes an operation portion 18 which extends outwardly and upwardly from the engaging portion 14.

In this embodiment, the bottom bar fixing device of Venetian blinds further includes at least one second fixing element 11 which is attached to a wall W or portions of a wall of a house corresponding to the first fixing elements 10 and has a plurality of loop members formed thereon for releasably engaging with the hook members of the first fixing element 10 so as to hold the bottom bar F of the Venetian blinds to the wall W when the Venetian blinds is in a fully extended state (see FIG. 2*d*). In this embodiment, the second fixing element 11 is attached to the wall W in an in-destructive way, e.g., by way of bonding, without using any power tools such that the wall W is prevented form being damaged. When the first fixing element 10 and the second fixing element 11 need to be separated to allow the bottom bar F and slats S of the Venetian blinds to be scrolled up, a user only needs to grape the operation portion 18 of the first fixing element 10 and pulls upwardly to separate the first fixing element 10 and the second fixing element 11.

Next, a second embodiment of the bottom bar fixing device of Venetian blinds of the present invention will be described with reference to FIGS. 3*a*-3*c*. As illustrated in FIGS. 3*a*-3*c*, the bottom bar fixing device of Venetian blinds includes two first fixing elements 10' attached to end portions of the bottom bar F of the Venetian blinds respectively (see FIGS. 3*a* and 3*b*). In this embodiment, the first fixing element 10' is constructed as a substantially L-shaped end cap having a plurality of hook members provided on a vertical rear face and a horizontal lower face thereof, which are obtained by adhering fastener straps with a plurality of hooks formed thereon to the vertical rear face and horizontal lower face.

According to this embodiment, the bottom bar fixing device of Venetian blinds further includes at least one second fixing element 11' which is attached to a wall W or portions of a wall of a house corresponding to the first fixing elements 10' (see FIG. 3*c*) and has a plurality of loop members formed thereon for releasably engaging with the hook members of the first fixing element 10' so as to hold the bottom bar F of the Venetian blinds to the wall W when the Venetian blinds is in a fully extended state (see FIG. 2*c*). Similar to the first embodiment, the second fixing element 11' is attached to the wall W in an in-destructive way, e.g., by way of bonding, without using any power tools such that the wall W is prevented form being damaged.

Although the present invention has been described above according to preferred embodiments of a bottom bar fixing device of Venetian blinds illustrated in the accompanying drawings, this does not mean that the scope of the present invention is limited to specific configurations of the bottom bar fixing device of Venetian blinds described above. It will be apparent to people skilled in this art that many modifications can be made to the disclosed structures without departing from the true scope of the invention defined by the appended claims. Therefore, it is the intent of the appended claims to cover all such variations and modifications as come within the sprit and scope of this invention.

What is claimed is:

1. A bottom bar fixing device of Venetian blinds, the Venetian blinds include a plurality of blinds (S) and a bottom bar (F) that are operably connected by at least two ladder ropes (R), the bottom bar fixing device comprising:

at least two first fixing elements attached to a lower face of the bottom bar of the Venetian blinds, each having an engaging portion which has a plurality of hook members provided thereon, and an operation portion extending outwardly and upwardly from the engaging portions; and at least two second fixing elements attached to a wall of a house, each second fixing element having loop portions formed thereon for engaging with the hook members of the first fixing element in order to releasably hold the bottom bar to the wall of the house by engaging the first and the second fixing elements when the Venetian blinds is in a fully extended state, wherein the at least two first fixing elements are configured in a form of a ladder rope fixing plug to fix the ladder rope to the bottom bar, and wherein the engaging portion is formed as an expanded base portion of the ladder rope fixing plug.

2. A bottom bar fixing device of Venetian blinds according to claim 1, wherein the second fixing elements are adhesively attached to the wall.

3. A bottom bar fixing device of Venetian blinds according to claim 1, wherein the ladder rope fixing plug includes an installation portion for inserting into a hole in the bottom bar of the Venetian blinds to attach the first fixing element to the bottom bar.

* * * * *